US011230101B2

(12) United States Patent
Kaneko et al.

(10) Patent No.: US 11,230,101 B2
(45) Date of Patent: Jan. 25, 2022

(54) LIQUID DISCHARGE HEAD AND RECORDING APPARATUS USING SAME

(71) Applicant: KYOCERA Corporation, Kyoto (JP)

(72) Inventors: Yusaku Kaneko, Kirishima (JP); Hiroyuki Kawamura, Kirishima (JP); Shota Kigure, Kirishima (JP); Wataru Ikeuchi, Kirishima (JP); Yifei Jiao, Changning District (CN)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/042,985

(22) PCT Filed: Mar. 15, 2019

(86) PCT No.: PCT/JP2019/010880

§ 371 (c)(1),
(2) Date: Sep. 29, 2020

(87) PCT Pub. No.: WO2019/188425

PCT Pub. Date: Oct. 3, 2019

(65) Prior Publication Data

US 2021/0008885 A1 Jan. 14, 2021

(30) Foreign Application Priority Data

Mar. 29, 2018 (JP) ..... JP2018-064798

(51) Int. Cl.
*B41J 2/14* (2006.01)

(52) U.S. Cl.
CPC .. *B41J 2/14201* (2013.01); *B41J 2002/14306* (2013.01); *B41J 2002/14419* (2013.01); *B41J 2002/14459* (2013.01); *B41J 2202/12* (2013.01)

(58) Field of Classification Search
CPC ..... B41J 2/14201; B41J 2202/12; B41J 2002/14459; B41J 2002/14419; B41J 2002/14306
See application file for complete search history.

(56) References Cited

U.S. PATENT DOCUMENTS 9,987,854 B2 * 6/2018 Kobayashi ..... B41J 2/155
2017/0253037 A1 9/2017 Kobayashi

FOREIGN PATENT DOCUMENTS

CN 106794695 A 5/2017
JP 2009-143168 A 7/2009

* cited by examiner

*Primary Examiner* — Geoffrey S Mruk
(74) *Attorney, Agent, or Firm* — Volpe Koenig

(57) ABSTRACT

A liquid discharge head includes: a first flow path member that discharges a liquid; a second flow path member including a supply flow path for sending the liquid to the first flow path member, and a collecting flow path for collecting the liquid from the first flow path member. The supply flow path includes a supply branch flow path that branches out at a center portion of the second flow path member in the first direction and extends in a first direction and in a third direction opposite thereto. The collecting flow path includes a collecting branch flow path that branches out at the center portion of the second flow path member in the first direction and extends in the first direction and in the third direction. When viewed in plan, the supply branch flow path and the collecting branch flow path overlap each other.

8 Claims, 11 Drawing Sheets

LIQUID DISCHARGE HEAD AND RECORDING APPARATUS USING SAME

TECHNICAL FIELD

The present disclosure relates to a liquid discharge head and a recording apparatus using the same.

BACKGROUND ART

In the related art, as a printing head, for example, a liquid discharge head that performs various types of printing by discharging a liquid onto a recording medium is known. In the liquid discharge head, for example, multiple discharge holes for discharging the liquid are disposed so as to extend two-dimensionally. Printing is performed by the liquid discharged from the respective discharge holes landing side by side on the recording medium (refer to, for example, PTL 1).

CITATION LIST

Patent Literature

PTL 1: Japanese Unexamined Patent Application Publication No. 2009-143168

SUMMARY OF INVENTION

A liquid discharge head of the present disclosure has a first flow path member and a second flow path member. The first flow path member has a shape in which a first direction is a longitudinal direction, and a liquid is discharged from the first flow path member. The second flow path member has a shape in which the first direction is a longitudinal direction, and includes a supply flow path and a collecting flow path. The supply flow path sends the liquid to the first flow path member. The collecting flow path collects the liquid not discharged from the first flow path member from the first flow path member.

The supply flow path includes a first opening that is open to an outside, and a supply branch flow path connected to the first opening. When the supply flow path is traced from the first opening, the supply branch flow path branches out at a center portion of the second flow path member in the first direction, extends in the first direction and in a third direction which is a direction opposite to the first direction, and is connected to the first flow path member at an end portion in the first direction and an end portion in the third direction.

The collecting flow path includes a second opening that is open to the outside, and a collecting branch flow path connected to the second opening. When the collecting flow path is traced from the second opening, the collecting branch flow path branches out at the center portion of the second flow path member in the first direction, extends in the first direction and in the third direction, and is connected to the first flow path member at an end portion in the first direction and an end portion in the third direction.

In addition, when viewed in plan, at least a part of the supply branch flow path and at least a part of the collecting branch flow path are disposed and overlap each other.

Further, a recording apparatus of the present disclosure includes: the liquid discharge head; a transport unit that transports a recording medium toward the liquid discharge head; and a control unit that controls the liquid discharge head.

DESCRIPTION OF EMBODIMENTS

Figure 1A:
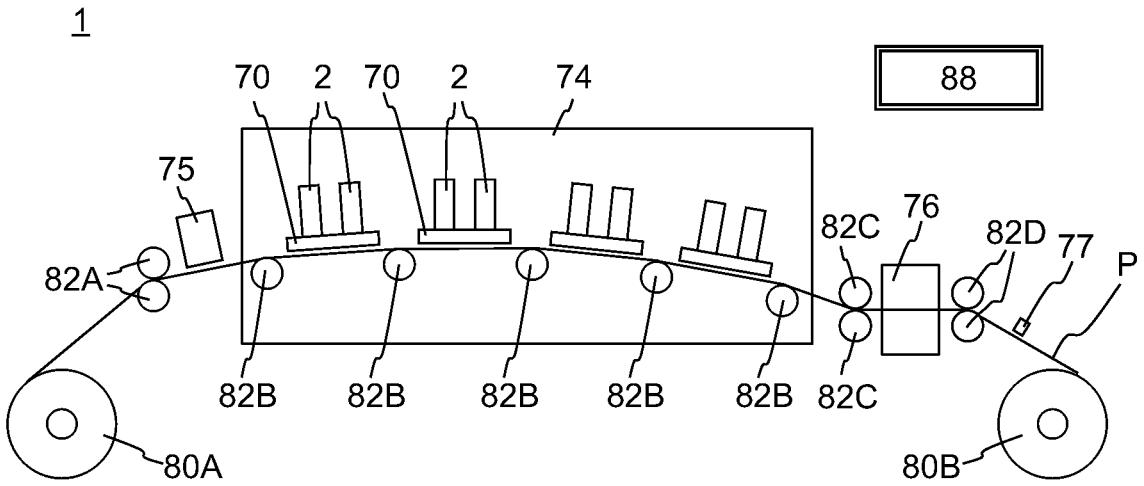
FIG. 1A is a side view of a recording apparatus including a liquid discharge head according to an embodiment of the present disclosure.
Figure 1B:
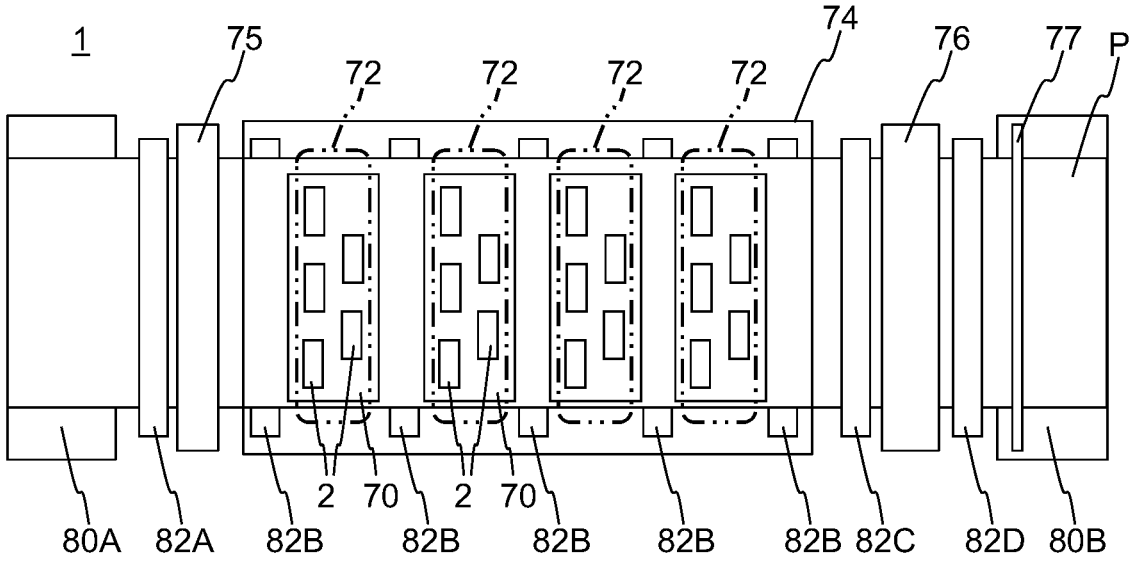
FIG. 1B is a plan view.

FIG. 1A is a schematic side view of a color ink jet printer (hereinafter, may be simply referred to as a printer) that is a recording apparatus including a liquid discharge head 2 according to an embodiment of the present disclosure, and FIG. 1B is a schematic plan view. The printer 1 includes the liquid discharge head 2 that discharges a liquid and a movable unit that moves a recording medium relative to the liquid discharge head 2. In the printer 1, the movable unit is each of rollers, such as transport rollers 82A, 82B, 82C, and 82D, a motor that drives the rollers, and the like. The movable unit transports a printing paper sheet P which is a recording medium from the transport roller 82A to the transport roller 82B and the transport roller 82C. A control unit 88 controls the liquid discharge head 2 based on print data, such as data of images, characters, and the like, to discharge the liquid toward the printing paper sheet P, to make droplets land on the printing paper sheet P, and to perform recording, such as printing on the printing paper sheet P.

In the present embodiment, the liquid discharge head 2 is fixed to the printer 1, and the printer 1 is a so-called line printer. As another embodiment of the recording apparatus, a so-called serial printer may be employed that moves the liquid discharge head 2, for example, reciprocally in a direction that intersects with a transport direction of the printing paper sheet P, for example, in a substantially orthogonal direction, while alternately performing an operation of discharging the droplets and transport of the printing paper sheet P. In the serial printer, the movable unit includes a carriage on which the liquid discharge head 2 is mounted, and a motor that reciprocates the carriage in the direction that intersects with the transport direction of the printing paper sheet P. The movable unit may include a roller that transports the printing paper sheet P, a motor that drives the roller, and the like.

Four flat head-mounted frames 70 (hereinafter, may be simply referred to as frames) are fixed to the printer 1 substantially parallel to the printing paper sheet P. Each frame 70 has five holes (not illustrated), and the five liquid discharge heads 2 are mounted in the respective hole parts. The five liquid discharge heads 2 on one frame 70 configure one head group 72. The printer 1 has four head groups 72 and a total of 20 liquid discharge heads 2 are mounted.

The liquid discharge head 2 on the frame 70 is configured such that the part that discharges the liquid faces the printing paper sheet P. A distance between the liquid discharge head 2 and the printing paper sheet P is, for example, approximately 0.5 to 20 mm.

The 20 liquid discharge heads 2 may be directly connected to the control unit 88 or may be connected via a distribution unit that distributes the print data therebetween. For example, the distribution unit may distribute the print data sent from the control unit 88 to the 20 liquid discharge heads 2. Further, for example, by using four distribution units that correspond to the four head groups 72, each distribution unit may distribute the print data sent from the control unit 88 to the four distribution units, to the five liquid discharge heads 2 in the corresponding head group 72.

The liquid discharge head 2 has a long shape elongated in a direction from a near side to a far side in FIG. 1A and in an up-down direction in FIG. 1B. Within the one head group 72, the three liquid discharge heads 2 are disposed along a direction that intersects with the transport direction of the printing paper sheet P, for example, in the substantially orthogonal direction, and the other two liquid discharge heads 2 are respectively disposed one by one between the three liquid discharge heads 2 at a position shifted along the transport direction. In other words, in one head group 72, the liquid discharge heads 2 are disposed in a zigzag manner. The liquid discharge heads 2 are disposed such that printable ranges of the respective liquid discharge heads 2 are connected to each other in a width direction of the printing paper sheet P, that is, in the direction that intersects with the transport direction of the printing paper sheet P, or such that the ends overlap each other, and the printing is enabled without gaps in the width direction of the printing paper sheet P.

The four head groups 72 are disposed along the transport direction of the printing paper sheet P. A liquid, for example, ink is supplied to each of the liquid discharge heads 2 from a liquid supply tank (not illustrated). The liquid discharge heads 2 that belong to one head group 72 are supplied with ink having the same color, and the four head groups 72 enables printing with four colors of the ink. The colors of ink discharged from the respective head groups 72 are, for example, magenta (M), yellow (Y), cyan (C), and black (K).

The number of liquid discharge heads 2 on the printer 1 may be one as long as printing is performed on the printable range of one liquid discharge head 2 in a single color. The number of liquid discharge heads 2 included in the head group 72 and the number of head groups 72 can be appropriately changed according to a printing target or printing conditions. For example, the number of head groups 72 may increase to perform multicolor printing. In addition, by disposing a plurality of head groups 72 that performs printing in the same color and alternately performs printing in the transport direction, the transport speed can increase even when the liquid discharge heads 2 having the same performance are used. In addition, the plurality of head groups 72 for printing in the same color may be prepared and disposed so as to be shifted in the direction that intersects with the transport direction, and the resolution of the printing paper sheet P in the width direction may increase.

Furthermore, in addition to the printing with the colored inks, a liquid, such as a coating agent, may be used to perform printing uniformly or in a patterned manner by the liquid discharge head 2 to perform surface treatment on the printing paper sheet P. As the coating agent, for example, when a medium into which the liquid does not easily penetrate is used as a recording medium, a coating agent that forms a liquid receiving layer can be used so that the liquid can be easily fixed. In addition, as a coating agent, when a medium into which the liquid easily penetrates is used as a recording medium, a coating agent that forms a liquid infiltration suppressing layer can be used such that the liquid does not mix with another liquid that has landed next while the liquid bleeding does not become extremely large. The coating agent may be uniformly applied by an application unit 75 controlled by the control unit 88 alternatively to the printing by the liquid discharge head 2.

The printer 1 performs printing on the printing paper sheet P that is a recording medium. The printing paper sheet P is in a state of being wound around a paper feed roller 80A, and the printing paper sheet P sent out from the paper feed roller 80A passes under the liquid discharge head 2 on the frame 70, then passes between the two transport rollers 82C, and is finally collected by a collection roller 80B. When performing the printing, the printing paper sheet P is transported at a constant speed by rotating the transport roller 82C and subjected to printing by the liquid discharge head 2.

Next, the details of the printer 1 will be described in an order in which the printing paper sheet P is transported. The printing paper sheet P sent out from the paper feed roller 80A passes between the two transport rollers 82A and then passes under the application unit 75. The application unit 75 applies the above-described coating agent to the printing paper sheet P.

Subsequently, the printing paper sheet P enters a head chamber 74 accommodating the frame 7 on which the liquid discharge head 2 is mounted. The head chamber 74 is connected to the outside at a part, such as a part where the printing paper sheet P goes in and out, but is substantially a space isolated from the outside. In the head chamber 74, control factors, such as temperature, humidity, and atmospheric pressure, are controlled by the control unit 88 and the like as necessary. In the head chamber 74, the influence of disturbance can be reduced compared to the outside where the printer 1 is installed, and thus, a fluctuation range of the above-described control factors can be narrower than the outside.

Five transport rollers 82B are disposed in the head chamber 74, and the printing paper sheet P is transported on the transport rollers 82B. The five transport rollers 82B are disposed such that the center is convex in the direction in which the frames 70 are disposed when viewed from the side. Accordingly, the printing paper sheet P transported on the five transport rollers 82B has an arc shape when viewed from the side, and by applying tension to the printing paper sheet P, the printing paper sheet P between the respective transport rollers 82B is stretched to form a flat surface. One frame 70 is disposed between the two transport rollers 82B. An angle at which each frame 70 is installed changes little by little so as to be parallel to the printing paper sheet P transported under the frame 70.

The printing paper sheet P that has gone out of the head chamber 74 passes between the two transport rollers 82C, passes through a drying unit 76, passes between the two transport rollers 82D, and is collected by the collection roller 80B. The transport speed of the printing paper sheet P is, for example, 100 to 200 m/min. Each roller may be controlled by the control unit 88 or may be manually operated by a person.

Drying in the drying unit 76 makes it difficult for the printing paper sheet P, which is wound up in an overlapping manner, to adhere to each other in the collection roller 80B or to be rubbed with undried liquid. To perform the printing at high speed, it is also necessary to perform the drying quickly. To speed up the drying, the drying unit 76 may sequentially perform the drying by a plurality of drying methods, or may perform the drying by using a plurality of drying methods in combination. Examples of the drying method used in such drying include blowing warm air, emitting infrared rays, and contacting a heated roller. When emitting infrared rays, infrared rays in a specific frequency range may be applied such that drying can be performed quickly while reducing damage to the printing paper sheet P. When the printing paper sheet P is brought into contact with the heated roller, the time during which heat is transmitted may be lengthened by transporting the printing paper sheet P along a cylindrical surface of the roller. The range to be transported is preferably ¼ or more, and more preferably ½ or more. When printing with UV curable ink or the like, a UV irradiation light source may be disposed instead of the drying unit 76 or in addition to the drying unit 76. The UV irradiation light source may be disposed between the respective frames 70.

The printing paper sheet P obtained by drying or curing the printed liquid so as to be collected by the collection roller 80B is captured by an imaging unit 77, and the printing state is confirmed. The confirmation of the printing state may be performed by printing a test pattern or printing target print data to be printed. Imaging may be performed while transporting the printing paper sheet P, that is, while printing other parts of the printing paper sheet P, or may be performed while transporting is stopped.

The captured image data is evaluated by the control unit 88 as to whether or not there is a part at which printing is not successfully completed or whether or not there is a part having poor printing accuracy. Specifically, it is evaluated whether or not there are no unprinted pixels since no droplets have been discharged, whether or not the discharge amount, the discharge speed, and the discharge direction of the discharged liquid are shifted from the target, or whether or not the landing position is shifted as the liquid is affected by a gas flow or the like while flying, or the spread of pixels after the landing is reduced or increased.

When the control unit 88 detects a shift or the like equal to or greater than a set threshold value in the image data, the control unit 88 may notify the result. Further, when printing is in progress, the printing may be stopped or the printing planned to be resumed may not be resumed.

Further, the control unit 88 may modify the print data so as to correct the shift detected in the image data, and cause the droplets to be discharged from the liquid discharge head 2 based on the modified print data. Specifically, when there is a pixel not printed, the control unit 88 creates print data in which the amount of liquid that lands around the pixel has increased relative to the original print data, and may drive the liquid discharge head 2 with the modified print data. Similarly, when the pixel density is high or when the pixel size is large, print data in which the amount of liquid that lands around the pixel is reduced may be created. When the landing position is shifted in a certain direction, print data in which the amount of liquid that lands in a shift direction is reduced and the amount of liquid that lands in a direction opposite to the shift direction increases may be created. The range in which the print data is modified may be not only a range including the pixel adjacent to the pixel where the shift is detected, but also a wider range.

The printer 1 may include a cleaning unit that cleans the liquid discharge head 2. The cleaning unit performs cleaning by wiping or capping, for example. In wiping, for example, a flexible wiper is used to remove the liquid that adheres to the surface by rubbing the surface where the liquid is discharged, for example, a nozzle surface 4-2 described later. The capping cleaning is performed as follows, for example. By covering the part where the liquid is discharged, for example, the nozzle surface 4-2 described later, with a cap (this is referred to as capping), the part is almost sealed with the nozzle surface 4-2 and the cap and a space is created. In such a state, by repeating the discharge of the liquid, the liquid having a higher viscosity than the standard state, foreign matter, and the like, which are clogged in the discharge hole 8, are removed. By capping, it is difficult for the liquid in the cleaning to scatter to the printer 1, and to adhere to a transport mechanism, such as the roller, or the printing paper sheet P. The nozzle surface 4-2 that has been cleaned may be further wiped. Wiping or cleaning with capping may be performed manually by a person operating a wiper or a cap attached to the printer 1 or automatically by the control unit 88.

The recording medium may be a roll-like cloth other than the printing paper sheet P. Further, the printer 1 may directly transport a transport belt instead of directly transporting the printing paper sheet P, and transport the recording medium placed on the transport belt. By doing so, cut-sheet paper, cut cloth, wood, tiles and the like can be used as the recording medium. Furthermore, a wiring pattern of an electronic device may be printed by discharging a liquid containing conductive particles from the liquid discharge head 2. Furthermore, a chemical may be produced by discharging a predetermined amount of liquid chemical agent or liquid containing a chemical agent from the liquid discharge head 2 toward a reaction container or the like and by making the liquid react.

In addition, a position sensor, a speed sensor, a temperature sensor, and the like may be attached to the printer 1, and the control unit 88 may control each part of the printer 1 in accordance with the state of each part of the printer 1 understood from information from each sensor. For example, when the temperature of the liquid discharge head 2, the temperature of the liquid in the liquid supply tank that supplies the liquid to the liquid discharge head 2, the pressure applied by the liquid in the liquid supply tank to the liquid discharge head 2, and the like, give influence to the discharge characteristics of the liquid to be discharged, that is, the discharge amount or the discharge speed, or the like, a driving signal for discharging the liquid may be changed corresponding to the information.

Figure 2A:
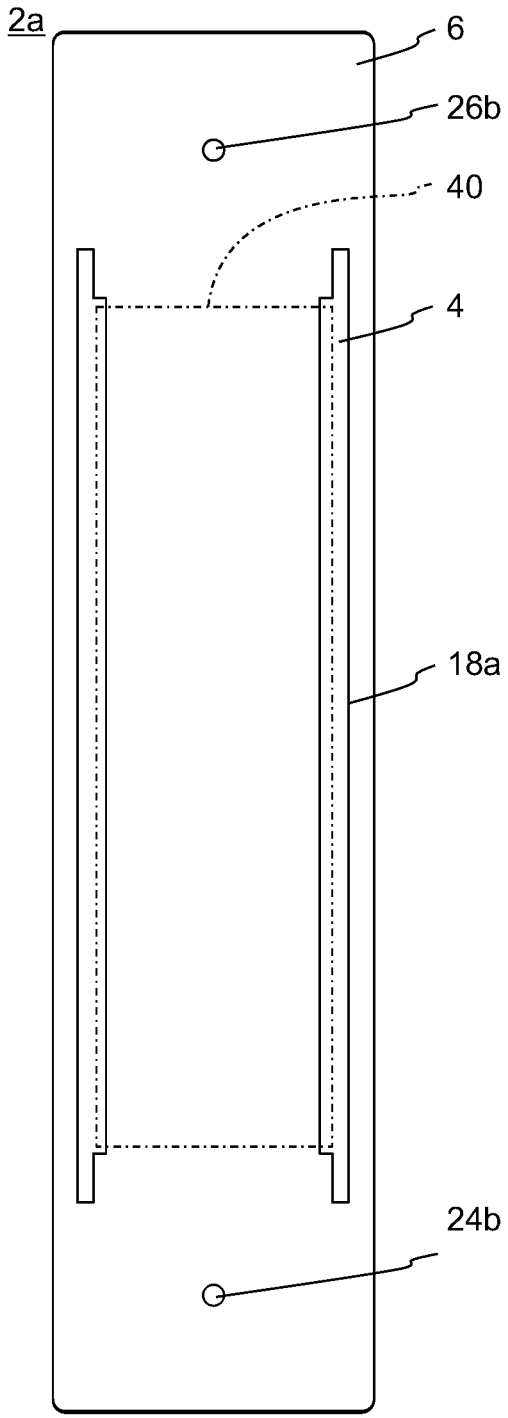
FIG. 2A is a plan view of a head main body that is a main part of the liquid discharge head of FIG. 1.
Figure 2B:
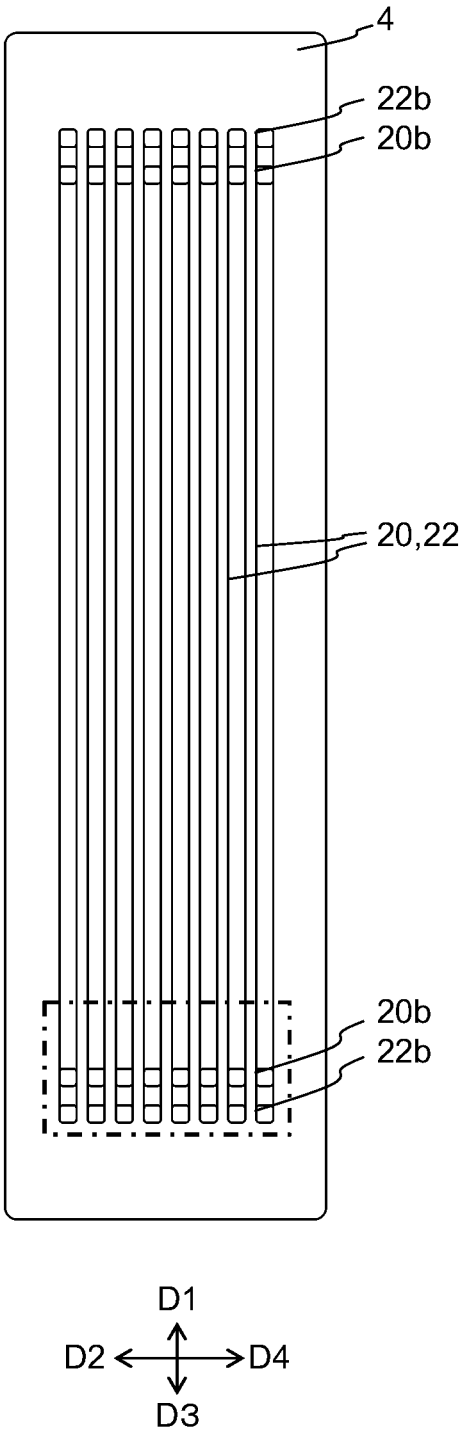
FIG. 2B is a plan view in which a second flow path member is removed from FIG. 2A.
Figure 3:
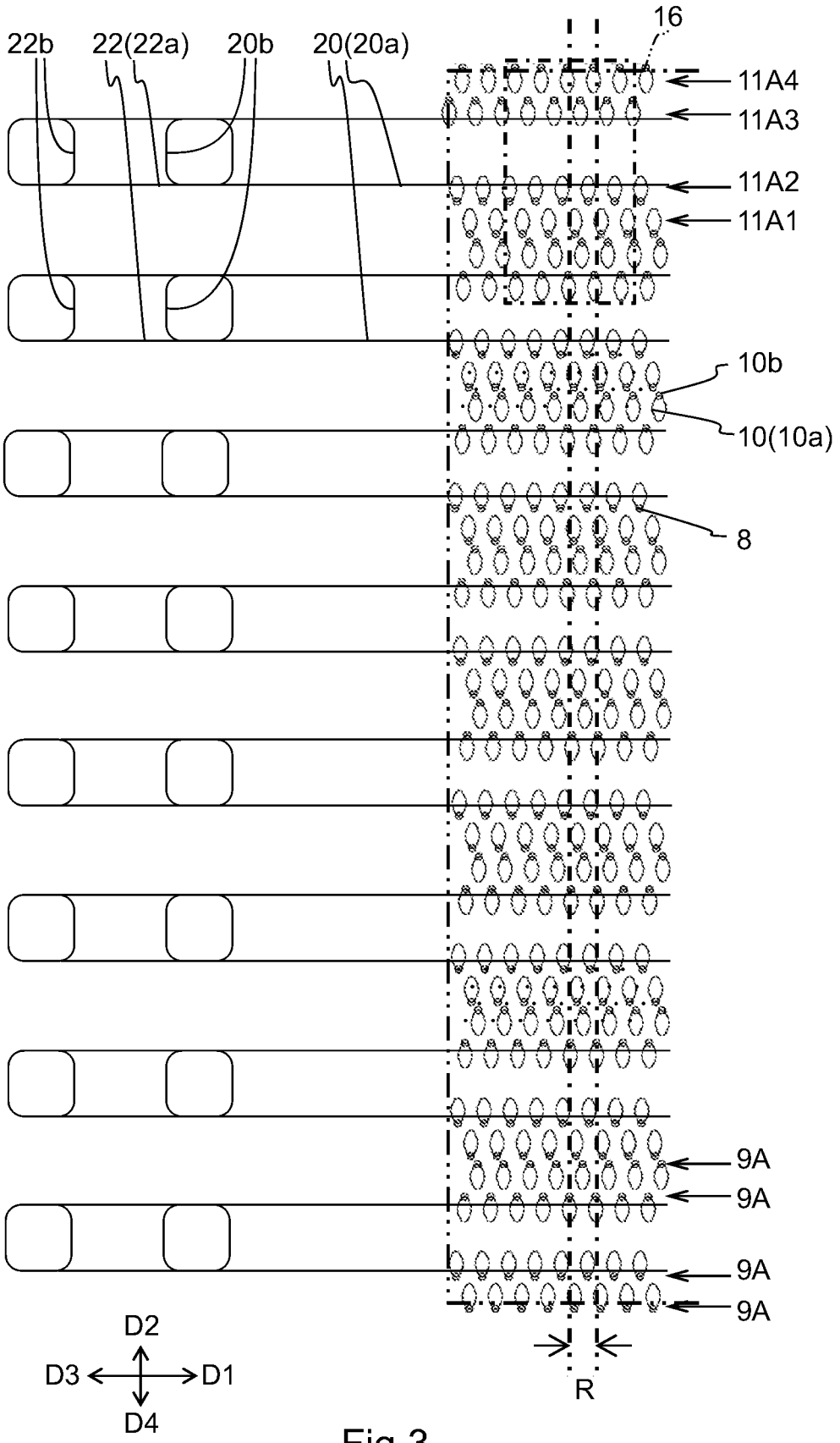
FIG. 3 is an enlarged plan view of a part of FIG. 2B.
Figure 4:
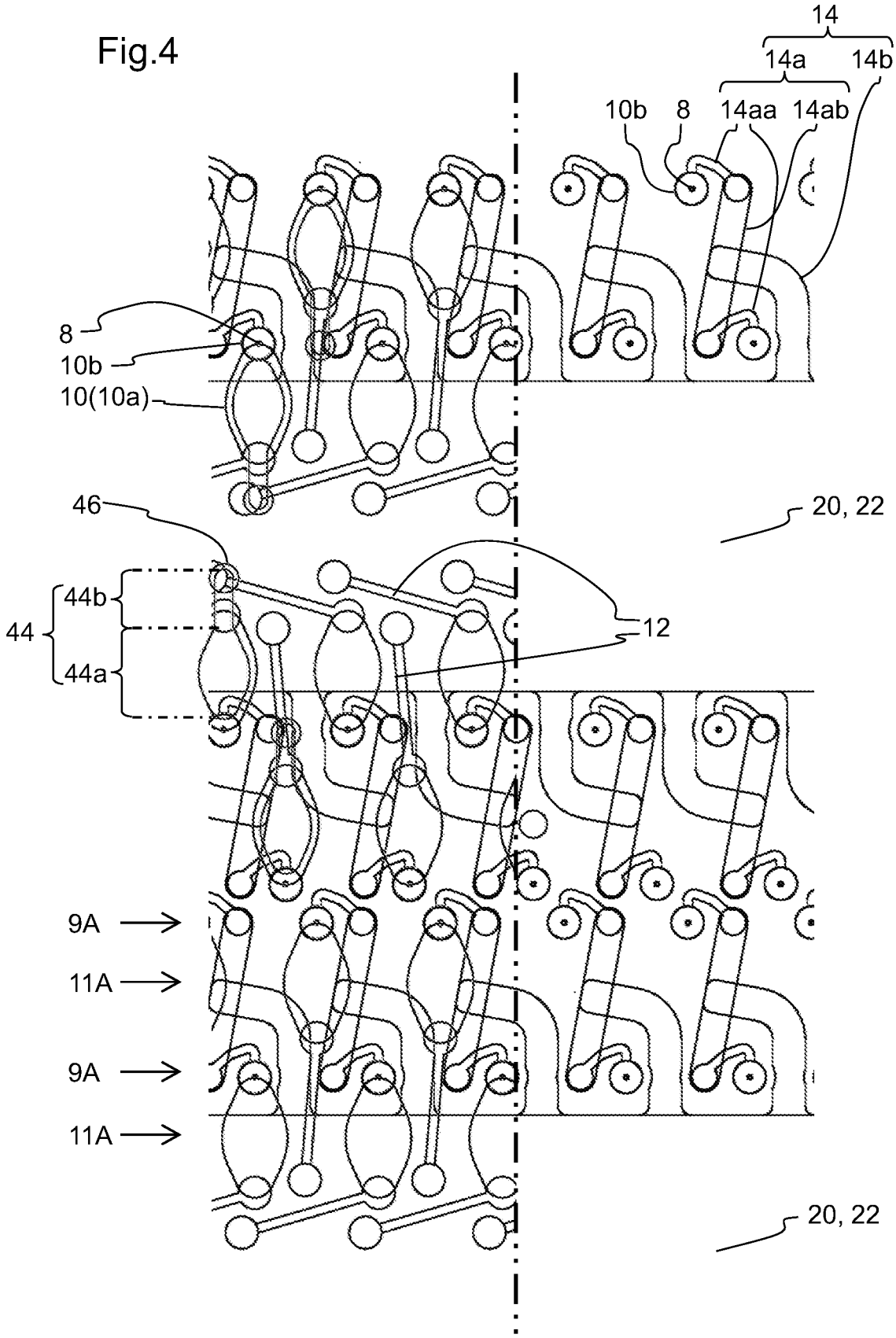
FIG. 4 is an enlarged plan view of a part of FIG. 2B.
Figure 5:
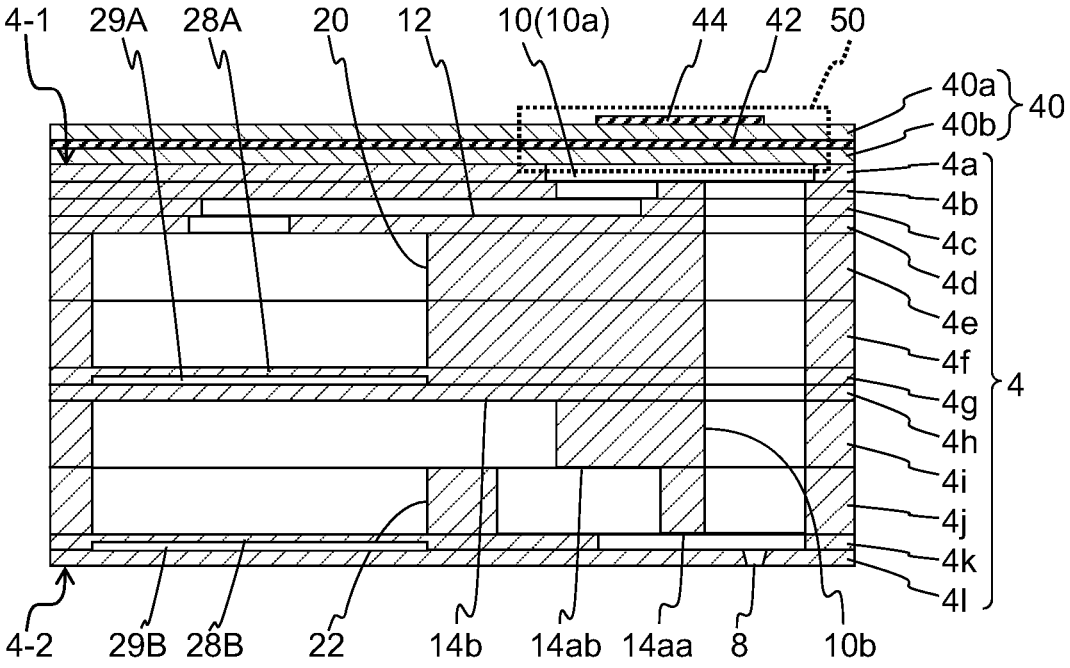
FIG. 5 is a schematic partial longitudinal sectional view of the head main body.

Next, the liquid discharge head 2 according to the embodiment of the present disclosure will be described. FIG. 2A is a plan view illustrating a head main body 2*a* which is a main part of the liquid discharge head 2 illustrated in FIG. 1. FIG. 2B is a plan view of a state where a second flow path member 6 is removed from the head main body 2*a*. FIG. 3 is an enlarged plan view of the head main body 2*a* in the range of one-dot chain line in FIG. 2B. FIG. 4 is an enlarged plan view of the head main body 2*a* in the range of one-dot chain line in FIG. 3. FIG. 5 is a schematic partial longitudinal sectional view of the head main body 2*a*. In FIG. 5, to illustrate the connected state of the flow paths, the flow paths that do not actually exist on the same longitudinal section are drawn. Specifically, the section above a plate 4*g* and the section below a plate 4*h* are different sections. Further, each section is a section along a bent line along the flow path.

Figure 6A:
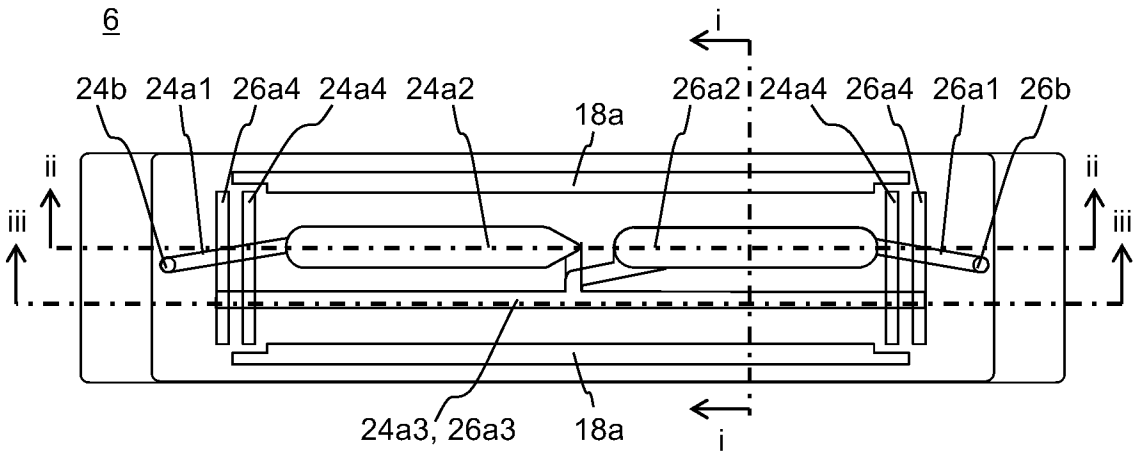
FIG. 6A is a plan view of an example of a second flow path member.
Figure 6B:
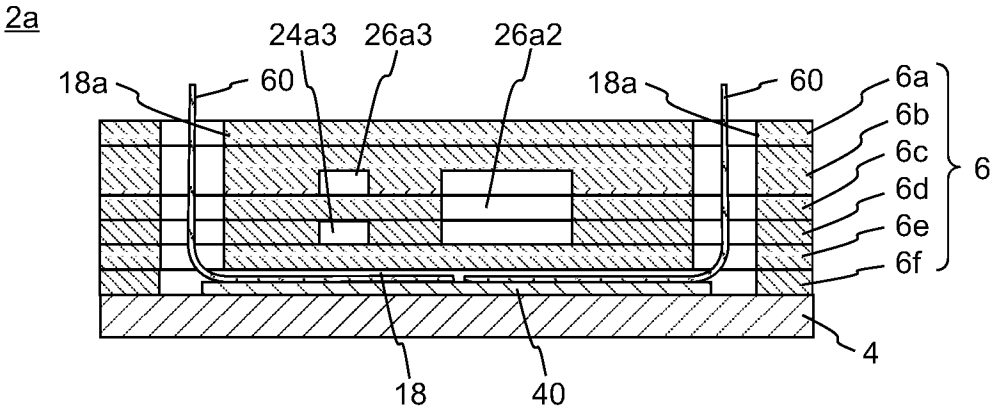
FIG. 6B is a longitudinal sectional view of the head main body taken along line i-i illustrated in 6A.
Figure 6C:
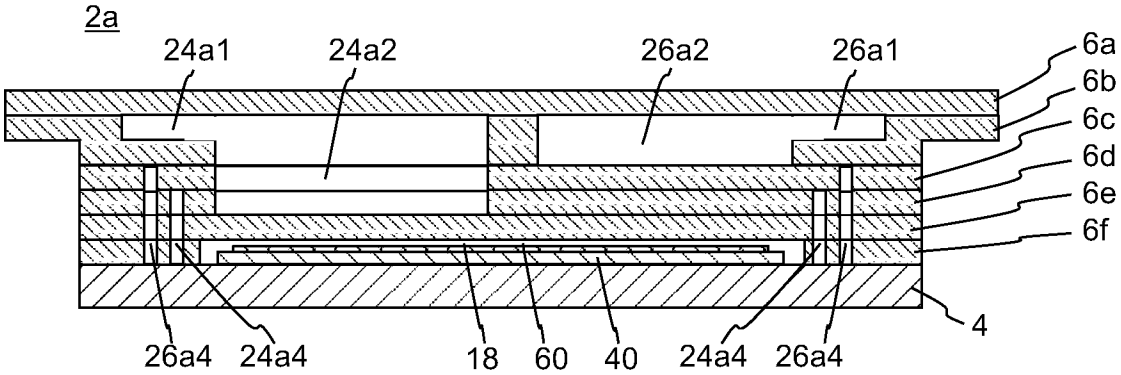
FIG. 6C is a longitudinal sectional view of the head main body taken along line ii-ii illustrated in FIG. 6A.
Figure 6D:
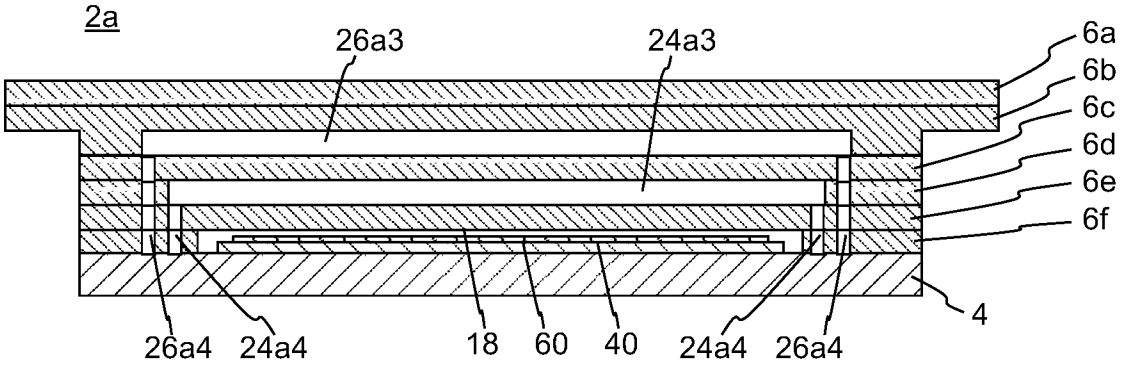
FIG. 6D is a longitudinal sectional view of the head main body taken along line iii-iii illustrated in FIG. 6A.

FIG. 6A is a plan view of the second flow path member 6, FIG. 6B is a longitudinal sectional view of the head main body 2*a* taken along line i-i illustrated in 6A, FIG. 6C is a longitudinal sectional view of the head main body 2*a* taken along line ii-ii illustrated in FIG. 6A, and FIG. 6D is a longitudinal sectional view of the head main body 2*a* taken along line iii-iii illustrated in FIG. 6A.

Figure 7:
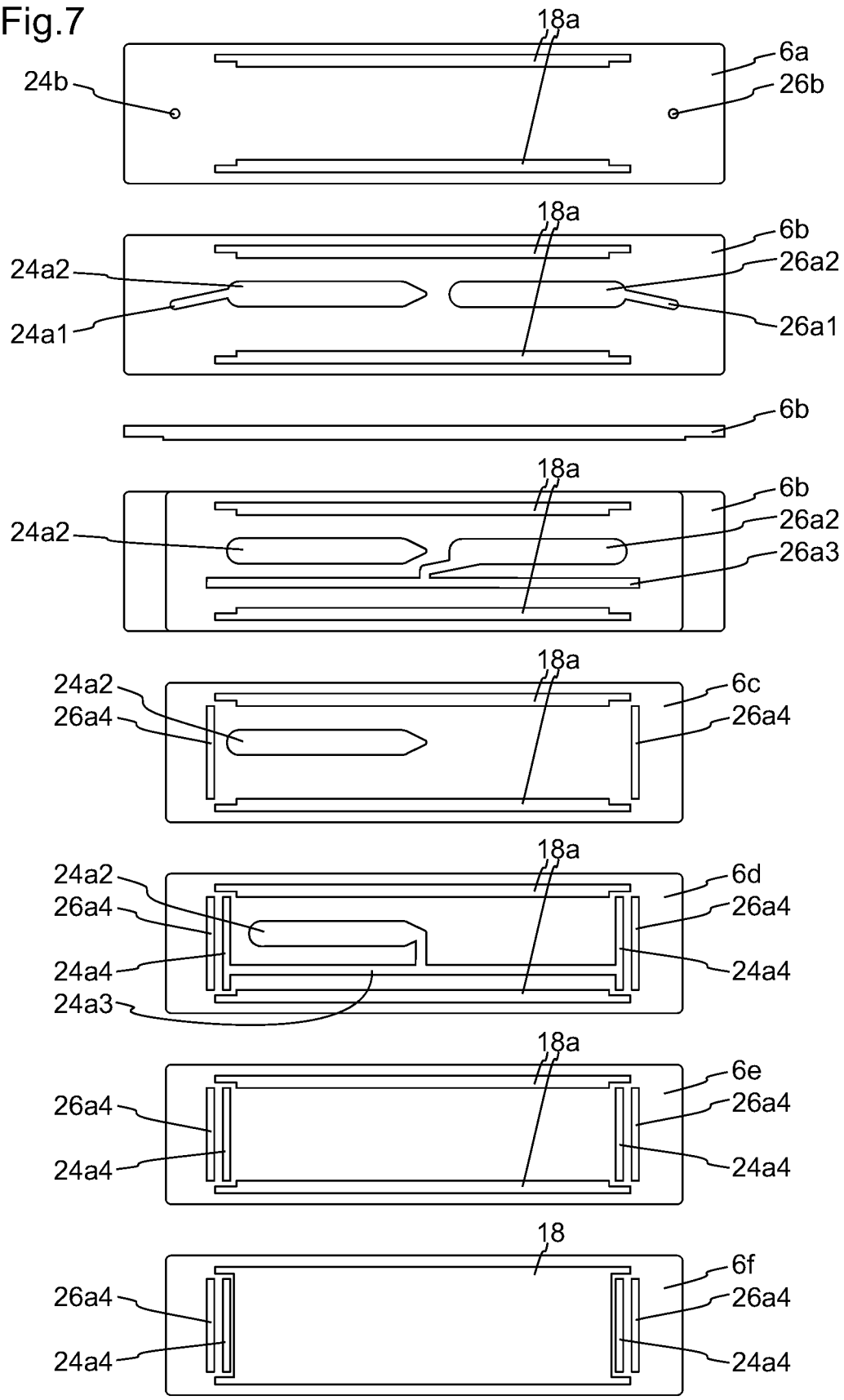
FIG. 7 is plan views and a side view of plates that form the second flow path member illustrated in FIG. 6.
Figure 8A:
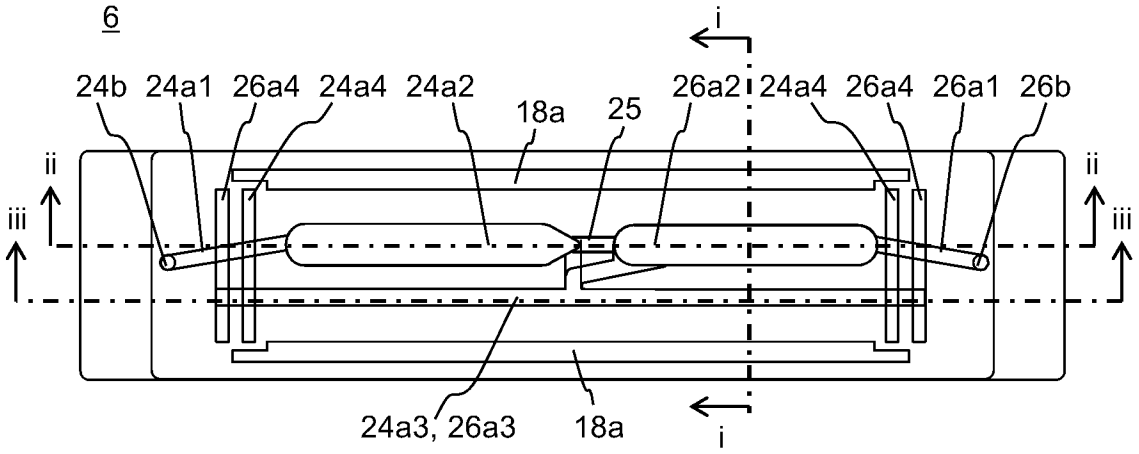
FIG. 8A is a plan view of another example of the second flow path member.
Figure 8B:
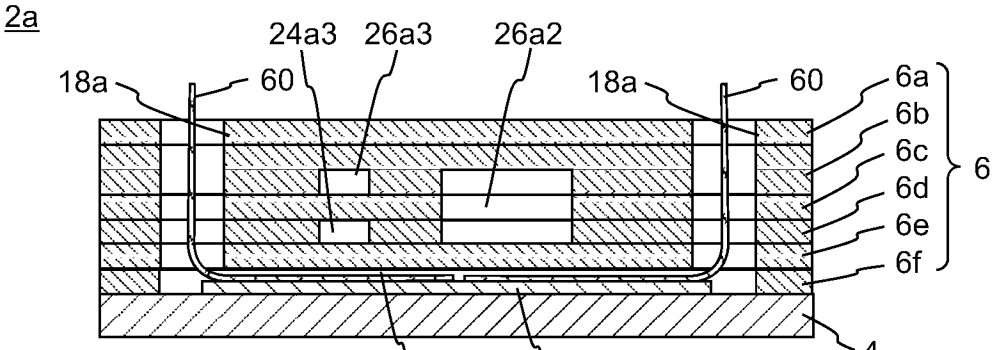
FIG. 8B is a longitudinal sectional view of the head main body taken along line i-i illustrated in 8A.
Figure 8C:
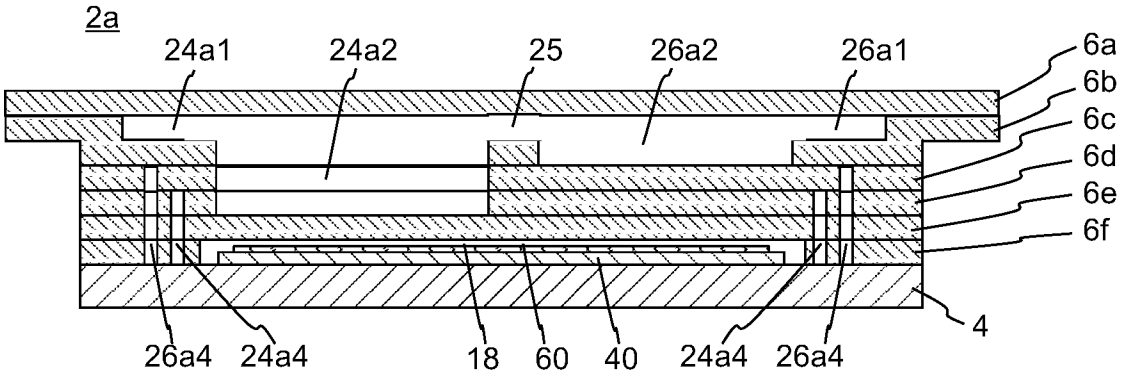
FIG. 8C is a longitudinal sectional view of the head main body taken along line ii-ii illustrated in FIG. 8A.
Figure 8D:
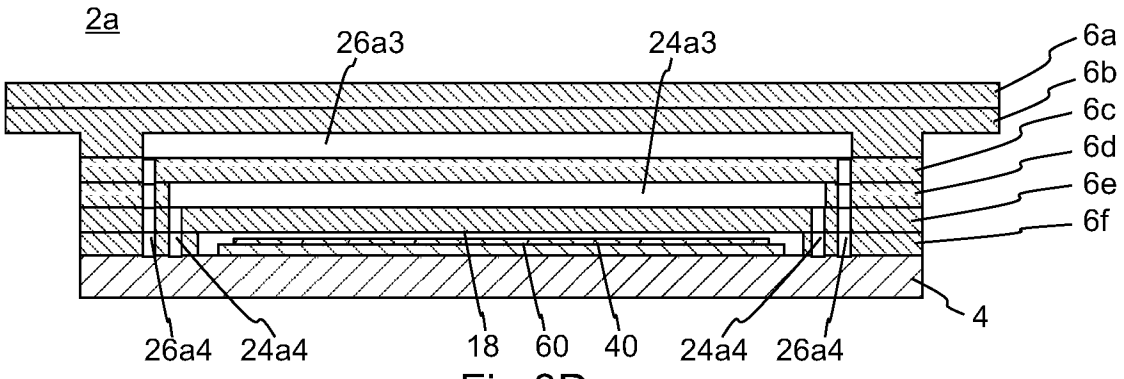
FIG. 8D is a longitudinal sectional view of the head main body taken along line iii-iii illustrated in FIG. 8A.

FIG. 7 is plan views and a side view of plates that forms the second flow path member 6. Specifically, in order from the top of FIG. 7, there are a top view of a plate 6*a*, a top view of a plate 6*b*, a side view of the plate 6*b*, a bottom view of the plate 6*b* (however, a state viewed from above is illustrated in order to make it comparison with other plate structures easy), a top view of a plate 6*c*, a top view of a plate 6*d*, a top view of a plate 6*e*, and a top view of a plate 6*f*.

Each drawing is drawn as follows in order to facilitate understanding of the drawings. In addition, in FIGS. 2 to 4 and 6A, the flow path and the like to be drawn with a broken line below other objects are drawn with a solid line. In FIG. 4, on the right side of the two-dot chain line at the center that divides the drawing into left and right, a first individual flow path 12, an individual electrode 44, and a connection electrode 46 are omitted.

The liquid discharge head 2 may include a metal housing, a driver IC, a wiring board, and the like, in addition to the head main body 2*a*. In addition, the head main body 2*a* includes the first flow path member 4, the second flow path member 6 that supplies a liquid to the first flow path member 4, and a piezoelectric actuator substrate 40 in which a displacement element 50 being a pressurizing unit is built. The head main body 2*a* has a flat plate shape that is long in one direction, and the direction may be referred to as a longitudinal direction. In addition, the second flow path member 6 serves as a support member that supports a structure of the head main body 2*a*, and the head main body 2*a* is fixed to the frame 70 at each of both end portions of the second flow path member 6 in the longitudinal direction.

The first flow path member 4 that configures the head main body 2*a* has a flat plate shape, and the thickness thereof is approximately 0.5 to 2 mm. In a pressurizing chamber surface 4-1, which is one surface of the first flow path member 4, multiple pressurizing chambers 10 are disposed side by side in a plane view direction. Multiple discharge holes 8 through which the liquid is discharged are disposed side by side in the plane view direction on the discharge hole surface 4-2 opposite to the pressurizing chamber surface 4-1 in the first flow path member 4. The discharge holes 8 are respectively connected to the pressurizing chamber 10. In the following description, the pressurizing chamber surface 4-1 is assumed to be positioned above the discharge hole surface 4-2.

In the first flow path member 4, a plurality of first common flow paths 20 and a plurality of second common flow paths 22 are disposed so as to extend along the first direction (D1 in FIGS. 2 and 3). Hereinafter, the first common flow path 20 and the second common flow path 22 may be collectively referred to as a common flow path. The first common flow path 20 and the second common flow path 22 are disposed so as to overlap each other. A direction in which the first common flow path 20 and the second common flow path 22 are disposed, and which intersects with the first direction is defined as a second direction (D2 in FIGS. 2 and 3). In addition, the first direction is the same direction as the longitudinal direction of the head main body 2*a*. Further, a direction opposite to the first direction is defined as a third direction (D3 in FIGS. 2 and 3), and a direction opposite to the second direction is defined as a fourth direction (D4 in FIGS. 2 and 3). The liquid discharge head 2 and the head main body 2*a* have a shape in which the first direction is the longitudinal direction. In other words, the liquid discharge head 2 and the head main body 2*a* have a shape in which the length in the first direction is longer than the length in the direction orthogonal to the first direction.

The pressurizing chambers 10 connected to the first common flow path 20 and the second common flow path 22 are disposed along both sides of the first common flow path 20 and the second common flow path 22, each side has two rows, and a total of four pressurizing chamber rows 11A are formed. Four pressurizing chamber rows 11A connected to the first common flow path 20 and the second common flow path 22 are sequentially called a first pressurizing chamber row 11A1, a second pressurizing chamber row 11A2, a third pressurizing chamber row 11A3, and a fourth pressurizing chamber row 11A4, in the second direction. The pressurizing chamber 10 that belongs to the first pressurizing chamber row 11A1 may be referred to as a first pressurizing chamber, and the second to fourth pressurizing chambers are also used in the same meaning.

The first common flow path 20 and the four pressurizing chamber rows 10 disposed on both sides thereof are connected to each other via the first individual flow paths 12. The second common flow path 22 and the four pressurizing chamber rows 10 disposed on both sides thereof are connected to each other via the second individual flow paths 14.

With the configuration described above, in the first flow path member 4, the liquid supplied to the first common flow path 20 flows into the pressurizing chambers 10 disposed along the first common flow path 20, part of the liquid is discharged from the discharge hole 8, and other part of the liquid flows into the second common flow path 22 disposed so as to overlap the first common flow path 20 and is discharged from the first flow path member 4 to the outside.

The first common flow path 20 is disposed so as to overlap the second common flow path. The first common flow path 20 is open to the outside of the first flow path member 4 at openings 20*b* disposed in both an end portion in the first direction and an end portion in the third direction, on the outside of the range where the first individual flow paths are connected. The second common flow path 22 is open to the outside of the first flow path member 4 at openings 22*b* disposed in both an end portion in the first direction and an end portion in the third direction, on the outside of the range where the second individual flow paths are connected and on the outside of the openings 20*b* of the first common flow path 20. Since the opening 22*b* of the second common flow path 22 on the lower side is disposed on the outside of the opening 20*b* of the first common flow path 20 on the upper side, the space efficiency is improved.

From the opening 20*a* of the first common flow path 20 on the first direction side and the opening 20*a* on the third direction side, the liquid is supplied substantially at the same amount, and flows toward the center of the first common flow path 20. When the discharge amount of the liquid from the discharge holes 8 connected to one first common flow path 20 and the second common flow path 22 is substantially constant regardless of the place, the flow in the first common flow path 20 becomes slower as approaching the center, and becomes 0 (zero) substantially at the center. The flow in the second common flow path 22 is opposite thereto, and is almost 0 (zero) at the center, and the flow becomes faster as approaching the outside.

Since various things are recorded by the liquid discharge head 2, the discharge amount of the liquid from the discharge holes 8 connected to one first common flow path 20 and the second common flow path 22 has various distributions. When the discharge amount from the discharge hole 8 on the first direction side is large, the place where the flow becomes 0 (zero) is closer to the first direction side than the center. Conversely, when the discharge amount from the discharge hole 8 on the third direction side is large, the place where the flow becomes 0 (zero) is closer to the third direction side than the center. In this manner, the place where the flow becomes 0 (zero) moves as the distribution of the discharge changes depending on what is recorded. Accordingly, even when the flow becomes 0 (zero) and the liquid stays at a certain moment, the staying at the place is eliminated since the distribution of the discharge changes, and thus, the liquid keeps staying at the same place, and accordingly, sedimentation of the pigment or sticking of the liquid may be less likely to occur.

The pressure applied to the part of the first individual flow path 12 on the first common flow path 20 side connected to the first common flow path 20 is affected by a pressure loss, and changes depending on the position (mainly, the position in the first direction) where the first individual flow path 12 is connected to the first common flow path 20. The pressure applied to the part on the second individual flow path 14 side connected to the second common flow path 22 is affected by a pressure loss, and changes depending on the position (mainly, the position in the first direction) where the second individual flow path 14 is connected to the second common flow path 22. When the pressure of the liquid in one discharge hole 8 is set to approximately 0 (zero), the above-described pressure change changes symmetrically, and thus, the liquid pressure in all of the discharge holes 8 can be set to approximately 0 (zero).

In such a configuration, when the viscosity of the liquid is 5 mPa·s or higher and 15 mPa·s or lower, the staying of the liquid may be less likely to occur. Furthermore, when the liquid supply tank for supplying the liquid to be discharged includes the stirring unit that stirs the liquid, the properties of the liquid supplied to the liquid discharge head 2 is stabilized, and thus the liquid can be more unlikely to stay.

In the above description, the openings 20*b* of the first common flow path 20 are disposed at the end portion in the first direction and the end portion in the third direction, but the two openings 20*b* may be disposed on the outside of the pressurizing chamber disposition range 16, in which the pressurizing chambers 10 are disposed, in the first direction and the third direction. Similarly, the two openings 22*b* of the second common flow path 22 may be disposed on the outside of the pressurizing chamber disposition range 16, where the pressurizing chambers 10 are disposed, in the first direction and the third direction. In addition, the pressurizing chamber disposition range 16 is a convex polygonal range that includes all of the pressurizing chambers 10 when viewed in plan.

In addition, the two openings 20*b* of the first common flow path 20 may be disposed on the outside of a connection range where the pressurizing chambers 10 connected to that first common flow path 20 are connected in the first direction and the third direction. Note that, the connection range where the pressurizing chambers 10 are connected is specifically a range in which a connection portion of the first individual flow path 12 on the first common flow path 20 side, that is, a flow path that connects the pressurizing chamber 10 and the first common flow path 20 to each other, is disposed in the first common flow path 20. The two openings 22*b* of the second common flow path 22 may be disposed on the outside of a connection range where the pressurizing chamber 10 connected to that second common flow path 22 are connected in the first direction and the third direction.

The lower surface of the first common flow path 20 is a damper 28A. The surface of the damper 28A opposite to the surface that faces the first common flow path 20 faces a damper chamber 29A. The damper chamber 29A contains a gas, such as air, and the volume thereof changes depending on the pressure applied from the first common flow path 20. The damper 28A can vibrate when the volume of the damper chamber 29A changes, and the pressure fluctuation generated in the first common flow path 20 can be attenuated when the vibration attenuates. By including the damper 28A, pressure fluctuations, such as resonance of the liquid in the first common flow path 20, can be reduced.

The lower surface of the second common flow path 22 is a damper 28B. The surface of the damper 28B opposite to the surface that faces the second common flow path 22 faces a damper chamber 29B. Similar to the case of the first common flow path, by including the damper 28B, pressure fluctuations, such as resonance of the liquid in the second common flow path 22, can be reduced.

In the present embodiment, respectively, there are eight first common flow paths 20 and eight second common flow paths 22. The pressurizing chamber 10 connected to each common flow path configures two pressurizing chamber rows 11A on one side and four pressurizing chamber rows 11A on both sides in the common flow path. Therefore, there are 32 pressurizing chamber rows 11A in total.

Four pressurizing chamber rows 11A connected to one first common flow path 20 and one second common flow path 22 are sequentially referred to as the first pressurizing chamber row 11A1, the second pressurizing chamber row 11A2, the third pressurizing chamber row 11A3, and the fourth pressurizing chamber row 11A4, in the second direction. Further, the pressurizing chambers 10 that belong to the respective pressurizing chamber rows are referred to as first to fourth pressurizing chambers in order.

The discharge holes 8 configure discharge hole rows 9A that correspond to the respective pressurizing chamber rows 11A, and there are 32 discharge hole rows 9A in total. In each of the discharge hole rows 9A, the discharge holes 8 are disposed at an interval of 50 dpi (approximately 25.4 mm/50). There are 32 discharge hole rows disposed so as to be shifted from each other, and accordingly, the discharge holes 8 are disposed at an interval of 1600 dpi as a whole.

More specifically, in FIG. 3, when the discharge holes 8 are projected in a direction orthogonal to the first direction, 32 discharge holes 8 are projected in the range of a virtual straight line R, and the respective discharge holes 8 within the virtual straight line R are disposed at an interval of 1200 dpi. Accordingly, when the printing paper sheet P is transported and subjected to printing in a direction orthogonal to the virtual straight line R, printing can be performed with a resolution of 1200 dpi.

The second flow path member 6 is joined to the pressurizing chamber surface 4-1 of the first flow path member 4, and has a first integrated flow path 24 which is a supply flow path for supplying the liquid to the first common flow path 20 and a second integrated flow path 26 which is a collecting flow path for collecting the liquid of the second common flow path 22. The thickness of the second flow path member 6 is larger than that of the first flow path member 4 and is approximately 5 to 30 mm.

The second flow path member 6 is joined in a region, where a piezoelectric actuator substrate 40 is not connected, on the pressurizing chamber surface 4-1 of the first flow path member 4. More specifically, the second flow path member 6 is joined to surround the piezoelectric actuator substrate 40. In this manner, adhesion of part of the discharged liquid to the piezoelectric actuator substrate 40 as mist may be suppressed. Further, since the first flow path member 4 is fixed on the outer periphery, it is possible to suppress vibration of the first flow path member 4 caused by the driving of the displacement element 50 and generation of resonance or the like.

An opening 24*b* (first opening) that is open to the upper surface of the second flow path member 6 is disposed at the end portion of the first integrated flow path 24 in the third direction. The opening 24*b* is open to the outside of the liquid discharge head 2. When the flow path is traced from the opening 24*b*, the first integrated flow path 24 has a first part 24*a*1 and subsequently a supply storage portion 24*a*2 (hereinafter, may be simply referred to as a storage portion 24*a*2). The storage portion 24*a*2 has a sectional area of the flow path larger than sectional areas of portions of the first integrated flow path 24 adjacent to the storage portion 24*a*2. In other words, the storage portion 24*a*2 has a sectional area of the flow path larger than sectional areas of the parts of the first integrated flow path 24 continuous with the storage portion 24*a*2.

Next to the storage portion 24*a*2, there is a supply branch flow path 24*a*3 (hereinafter, may be simply referred to as a branch flow path 24*a*3). The branch flow path 24*a*3 branches out at the center portion of the second flow path member 6 in the first direction into a flow path that extends in the first direction and a flow path that extends in the third direction. In addition, the center portion is within a range of ⅓ of the length of the second flow path member 6 in the first direction, centered on the center of the second flow path member 6 in the first direction, and is within the range of ⅕, particularly within the range of 1/10.

Second branch flow path 24*a*4 are at both tips of the flow path that extends in the first direction and the flow path that extends in the third direction. Each of the second branch flow paths 24*a*4 also branches out in the second direction and in the fourth direction, and the branch is connected to the opening 20*b* of the first common flow path 20 of the first flow path member 4.

An opening 26*b* (second opening) that is open to the upper surface of the second flow path member 6 is disposed at the end portion of the second integrated flow path 26 in the first direction. The opening 26*b* is open to the outside of the liquid discharge head 2. When the flow path is traced from the opening 26*b*, the second integrated flow path 26 has a first part 26*a*1 and subsequently a collecting storage portion 26*a*2 (hereinafter, may be simply referred to as a storage portion 26*a*2). The storage portion 26*a*2 has a sectional area of the flow path larger than sectional areas of portions of the second integrated flow path 26 adjacent to the storage portion 26*a*2. In other words, the storage portion 26*a*2 has a sectional area of the flow path larger than sectional areas of the parts of the second integrated flow path 26 continuous with the storage portion 26*a*2.

Next to the storage portion 26*a*2, there is a collecting branch flow path 26*a*3 (hereinafter, may be simply referred to as a branch flow path 26*a*3). The branch flow path 26*a*3 branches out at the center portion of the second flow path member 6 in the first direction into a flow path that extends in the first direction and a flow path that extends in the third direction.

Second branch flow path 26*a*4 are at both tips of the flow path that extends in the first direction and the flow path that extends in the third direction. Each of the second branch flow paths 26*a*4 also branches out in the second direction and in the fourth direction, and the branch is connected to the opening 22*b* of the second common flow path 22 of the first flow path member 4.

When printing is performed, the liquid is supplied from the outside to the opening 24*b* of the first integrated flow path 24, and the liquid that has not been discharged is collected from the opening 26*b* of the second integrated flow path 26.

A storage space 18 for the piezoelectric actuator substrate 40 is provided on the lower surface of the second flow path member 6. The storage space 18 has through holes 18*a* that penetrate the second flow path member 6 to the upper surface at end portions in the second direction and in the fourth direction. A signal transmission unit 60, such as a flexible printed circuit (FPC) that transmits a driving signal for driving the piezoelectric actuator substrate 40, passes through the through holes 6*a*.

When viewed in plan, the supply branch flow path 24*a*3 and the collecting branch flow path 26*a*3 are disposed such that at least some parts thereof overlap each other. In other words, when viewed in plan, at least a part of the supply branch flow path 24*a*3 and at least a part of the collecting branch flow path 26*a*3 are disposed so as to overlap each other. By disposing the supply branch flow path 24*a*3 and the collecting branch flow path 26*a*3 so as to overlap each other in an up-down direction, the space utilization efficiency can be increased and the size of the head main body 2*a* can be reduced as compared with a case where the supply branch flow path 24*a*3 and the collecting branch flow path 26*a*3 are disposed side by side on the same plane. In addition, as illustrated in FIG. 6, when the collecting branch flow path 26*a*3 is disposed so as to overlap the entire region along the longitudinal direction (first direction and third direction) of the supply branch flow path 24*a*3, the space utilization efficiency can further be improved.

Further, the collecting branch flow path 26*a*3 may be disposed on a side of the supply branch flow path 24*a*3 opposite to a side where the first flow path member 4 is disposed. In other words, the collecting branch flow path 26*a*3 may be disposed above the supply branch flow path 24*a*3 so as to cover the supply branch flow path 24*a*3. When the temperature of the liquid to be discharged fluctuates, there is a concern that the discharge characteristics, such as discharge amount and discharge speed, fluctuates. By disposing the collecting branch flow path 26*a*3 on the outside of the supply branch flow path 24*a*3, it is possible to reduce the temperature change of the supply branch flow path 24*a*3 due to heat exchange with the outside, and it is possible to reduce the fluctuation of the discharge characteristics.

In addition, a connection portion between the end portion of the second integrated flow path 26 in the first direction and the first flow path member 4 can be disposed closer to a first direction side than a connection portion between the end portion of the first integrated flow path 24 in the first direction and the first flow path member 4, and a connection portion between the end portion of the second integrated flow path 26 in the third direction and the first flow path member 4 can be disposed closer to a third direction side than a connection portion between the end portion of the first integrated flow path 24 in the third direction and the first flow path member 4. With such a configuration, it is possible to reduce the temperature change of the supply branch flow path 24*a*3 due to heat exchange with the outside, and it is possible to reduce the fluctuation of the discharge characteristics. Further, the space utilization efficiency can be increased, and the size of the head main body 2*a* can be reduced.

In addition, when viewed in plan, the supply storage portion 24*a*2 and the collecting storage portion 26*a*2 may be disposed so as to be displaced in the second direction which is a direction intersecting with the first direction from the supply branch flow path 24*a*3 and the collecting branch flow path 26*a*3. In other words, when viewed in plan, the supply storage portion 24*a*2 and the collecting storage portion 26*a*2 may be disposed to be displaced in the second direction from the position where the supply branch flow path 24*a*3 and the collecting branch flow path 26*a*3 are positioned such that the supply storage portion 24*a*2 and the collecting storage portion 26*a*2 do not overlap the supply branch flow path 24*a*3 and the collecting branch flow path 26*a*3. Further, the supply storage portion 24*a*2 and the collecting storage portion 26*a*2 may be disposed side by side in the first direction. With such a configuration, the space utilization efficiency can be improved, and the size of the supply storage portion 24*a*2 and the collecting storage portion 26*a*2 can be reduced while the volume of the supply storage portion 24*a*2 and the collecting storage portion 26*a*2 is increased.

In addition, a connection portion between a flow path extending from the supply storage portion 24*a*2 toward the supply branch flow path 24*a*3 and the supply storage portion 24*a*2 may be disposed at a position closer to the center of the second flow path member 6 in the first direction than a connection portion between a flow path extending from the collecting storage portion 26*a*2 toward the collecting branch flow path 26*a*3 and the collecting storage portion 26*a*2.

When a disturbance occurs, there is a concern that the supply branch flow path 24*a*3 and the collecting branch flow path 26*a*3 transmits the influence of the disturbance to the first flow path member. When the influence of the disturbance is transmitted to the first flow path member 4 evenly, the difference in the influence due to the position of the discharge hole 8 can be reduced. Therefore, it is desirable that both the flow path extending from the supply storage portion 24*a*2 toward the supply branch flow path 24*a*3 and the flow path extending from the collecting storage portion 26*a*2 to the collecting branch flow path 26*a*3 are disposed at the center in the first direction. However, in such a case, the use efficiency of the space significantly deteriorates. Therefore, the supply branch flow path 24*a*3, which is more influenced by the disturbance than the collecting branch flow path 26*a*3, can be disposed near the center in the first direction.

Further, the volume of the supply storage portion 24*a*2 may be larger than the volume of the collecting storage portion 26*a*2. With such a configuration, it is possible to suppress the pressure fluctuation during the supply of the liquid and improve the printing stability.

In addition, a damper may be provided in the storage portion 24*a*2 of the first integrated flow path 24 and the storage portion 26*a*2 of the second integrated flow path 26, and the supply or discharge of the liquid may be stabilized against fluctuations in the discharge amount of the liquid. Further, by including a filter in the storage portion 24*a*2 of the first integrated flow path 24 or the storage portion 26*a*2 of the second integrated flow path 26 or between the first integrated flow path 24 and the first common flow path 20 and or between the second integrated flow path 26 and the second common flow path 22, foreign matters or bubbles may be difficult to enter the first flow path member 4.

Figure 9:
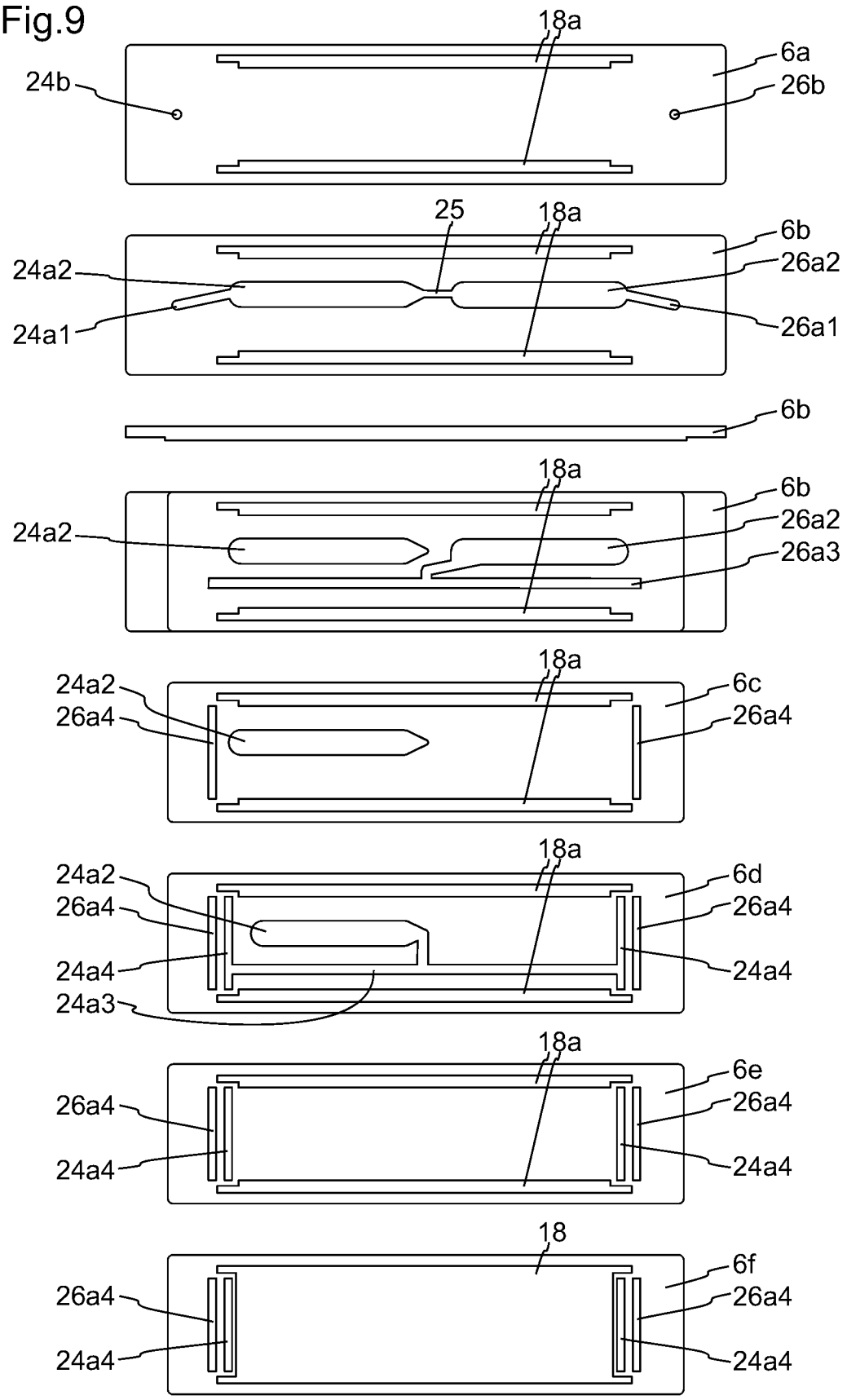
FIG. 9 is plan views and a side view of a plate that forms the second flow path member illustrated in FIG. 8.

Further, as illustrated in FIGS. 8 and 9, the supply storage portion 24*a*2 and the collecting storage portion 26*a*2 may be connected to each other by a bypass flow path 25. By the bypass flow path 25, the bubbles flowing into the supply storage portion 24*a*2 can be sent to the collecting storage portion 26*a*2 without flowing into the supply branch flow path 24*a*3, and the stability of liquid discharge can be improved. In FIGS. 8 and 9, the bypass flow path 25 is formed by a groove in the plate 6*c*. When the bypass flow path 25 is configured to connect the uppermost part of the supply storage portion 24*a*2 and the uppermost part of the collecting storage portion 26*a*2, it is possible to enhance the discharging properties of bubbles.

The flow path resistance of the bypass flow path 25 may be larger than the flow path resistance of the supply branch flow path 24*a*3. In this case, the bubbles can be sent from the supply storage portion 24*a*2 to the collecting storage portion 26*a*2, and the decrease in the flow rate of the liquid flowing from the supply storage portion 24*a*2 to the supply branch flow path 24*a*3 can be reduced. For example, by making the sectional area of the transverse section of the bypass flow path 25 smaller than the sectional area of the transverse section of the supply branch flow path 24*a*3, the flow path resistance of the bypass flow path 25 can become larger than the flow path resistance of the supply branch flow path 24*a*3. The flow path resistance of the bypass flow path 25 can be, for example, approximately 2 to 10 times the flow path resistance of the supply branch flow path 24*a*3.

The piezoelectric actuator substrate 40 including the displacement element 50 is joined to the pressurizing chamber surface 4-1 which is the upper surface of the first flow path member 4, and each of the displacement elements 50 is disposed on the pressurizing chamber 10. The piezoelectric actuator substrate 40 occupies a region having substantially the same shape as the pressurizing chamber group constituted by the pressurizing chambers 10. Further, the openings of the respective pressurizing chambers 10 are closed by joining the piezoelectric actuator substrate 40 to the pressurizing chamber surface 4-1 of the flow path member 4. The piezoelectric actuator substrate 40 has a rectangular shape that is long in the same direction as the head main body 2*a*. In addition, the piezoelectric actuator substrate 40 is connected to the signal transmission unit 60, such as an FPC for supplying a signal to each of the displacement elements 50. The second flow path member 6 has through holes 18*a* that penetrate the second flow path member 6 at the center in the up-down direction, and the signal transmission unit 60 is electrically connected to the control unit 88 through the through holes 18*a*. The signal transmission unit 60 has a shape that extends in the short direction from one end of a long side of the piezoelectric actuator substrate 40 toward the other end of the long side, and when the wires in the signal transmission unit extend along the short direction and are disposed in the longitudinal direction, the distance between the wires can increase.

Individual electrodes 44 are disposed at positions opposing the respective pressurizing chambers 10 on the upper surface of the piezoelectric actuator substrate 40.

The flow path member 4 has a laminated structure in which a plurality of plates is laminated. A plate 4*a* is disposed on the pressurizing chamber surface 4-1 side of the flow path member 4, and plates 4*b* to 4*l* are sequentially laminated under the plate 4*a*. In addition, the plate 4*a* in which the hole as the side wall of the pressurizing chamber 10 is included may be called the cavity plate 4*a*, and the plates 4*e, f, i*, and *j* in which the hole as the side wall of the common flow path is included may be called the manifold plates 4*e, f, i*, and *j*, and the plate 4*l* in which the discharge holes 8 are open may be called the nozzle plate 4*l*. Each plate has multiple holes or grooves. For example, the holes or grooves can be formed by etching each plate made of metal. Since the thickness of each plate is approximately 10 to 300 μm, the formation accuracy of the holes to be formed can be increase. The respective plates are aligned and laminated such that the holes communicate with each other to constitute a flow path, such as the first common flow path 20.

A pressurizing chamber main body 10*a* is open on the pressurizing chamber surface 4-1 of the flat flow path member 4, and the piezoelectric actuator substrate 40 is joined thereto. In addition, the pressurizing chamber surface 4-1 has an opening 20*b* for supplying the liquid to the first common flow path 20 and an opening 22*b* for collecting the liquid from the second common flow path 22. The discharge hole 8 is open on the discharge hole surface 4-2 opposite to the pressurizing chamber surface 4-1 of the flow path member 4.

As a structure for discharging the liquid, there are the pressurizing chamber 10 and the discharge hole 8. The pressurizing chamber 10 includes the pressurizing chamber main body 10*a* that faces the displacement element 50 and a descender 10*b* having a sectional area smaller than that of the pressurizing chamber main body 10*a*. The pressurizing chamber main body 10*a* is formed in the cavity plate 4*a*, and the descender 10*b* is formed by overlapping the holes formed on the plates 4*b* to 4*k*, and further (parts other than the discharge hole 8) being blocked by the nozzle plate 4*l*.

The first individual flow path 12 is connected to the pressurizing chamber main body 10*a*, and the first individual flow path 12 is connected to the first common flow path 20. The first individual flow path 12 includes a circular hole that penetrates the plate 4*b*, an elongated penetrating groove that extends in the plane direction of the plate 4*c*, and a circular hole that penetrates the plate 4*d*.

The second individual flow path 14 is connected to the descender 10*b*, and the second individual flow path 14 is connected to the second common flow path 22. The second individual flow path 14 includes: a first part 14*a* having an elongated penetrating groove that is connected from a circular hole serving as the partial flow path 10*b* of the plate 4*k* and extends in the plane direction, and a circular hole that penetrates the plate 4*j*; and a second part 14*b* which is a rectangular hole that penetrates the plate 4*i* and is connected to a penetrating groove that becomes the second common flow path 22. The second part 14*b* is shared with the second individual flow path 14 connected from another descender 10*b*, and the first parts 14*a* of the two second individual flow paths 14 are connected to the second common flow path 22 after being joined together at the second part 14*b* of the plate 4*i*.

The first common flow path 20 is formed by overlapping the holes in the plates 4*e* and *f*, and by further covering the upper side with the plate 4*d* and the lower side with the plate 4*g*. The second common flow path 22 is formed by overlapping holes in the plates 4*i* and *j*, and by further covering the upper side with the plate 4*h* and the lower side with the plate 4*k*.

Summarizing the flow of the liquid, the liquid supplied to the first integrated flow path 24 passes through the first common flow path 20 and the first individual flow path 12 in order, and enters the pressurizing chamber 10, and a part of the liquid is discharged from the discharge hole 8. The liquid that has not been discharged passes through the second individual flow path 14, enters the second common flow path 22, enters the second integrated flow path 26, and is discharged to the outside of the head main body 2*a*.

The piezoelectric actuator substrate 40 has a laminated structure configured with two piezoelectric ceramic layers 40*a* and 40*b* which are piezoelectric bodies. Each of the piezoelectric ceramic layers 40*a* and 40*b* has a thickness of approximately 20 μm. In other words, the thickness from the upper surface of the piezoelectric ceramic layer 40*a* to the lower surface of the piezoelectric ceramic layer 40*b* in the piezoelectric actuator substrate 40 is approximately 40 μm. The thickness ratio between the piezoelectric ceramic layer 40*a* and the piezoelectric ceramic layer 40*b* is set to 3:7 to 7:3, and preferably 4:6 to 6:4. Both of the piezoelectric ceramic layers 40*a* and 40*b* extend so as to straddle the plurality of pressurizing chambers 10. The piezoelectric ceramic layers 40*a* and 40*b* are made of, for example, a ceramic material, such as lead zirconate titanate (PZT), $NaNbO_3$, $BaTiO_3$, $(BiNa)NbO_3$, or $BiNaNb_5O_{15}$ having ferroelectricity.

The piezoelectric ceramic layer 40*b* does not have a structure sandwiched between electrodes and the like which will be described below. In other words, in the piezoelectric ceramic layer 40*b*, even when the driving signal is applied to the displacement element 50, spontaneous piezoelectric deformation is practically not performed, and the piezoelectric ceramic layer 40*b* functions as a diaphragm. Therefore, the piezoelectric ceramic layer 40*b* can be changed to other ceramic having no piezoelectricity or a metal plate. Further, a metal plate may be laminated under the piezoelectric ceramic layer 40*b*, and both the piezoelectric ceramic layer 40*b* and the metal plate may be used as a diaphragm. In addition, with such a structure, the metal plate can also be regarded as a part of the first flow path member 4.

The piezoelectric actuator substrate 40 has a common electrode 42 made of a metal material, such as Ag—Pd, and the individual electrode 44 made of a metal material, such as Au. The thickness of the common electrode 42 is approximately 2 μm, and the thickness of the individual electrode 44 is approximately 1 μm.

The individual electrodes 44 are disposed at positions opposing the respective pressurizing chambers 10 on the upper surface of the piezoelectric actuator substrate 40. The individual electrode 44 includes: an individual electrode main body 44*a* having a shape in plan view that is slightly smaller than the pressurizing chamber main body 10*a* and having a shape substantially similar to the pressurizing chamber main body 10*a*; and an extraction electrode 44*b* extracted from the individual electrode main body 44*a*. The connection electrode 46 is formed at a part of one end of the extraction electrode 44*b* that is extracted to the outside of the region opposing the pressurizing chamber 10. The connection electrode 46 is a conductive resin that contains conductive particles, such as silver particles, and is formed with a thickness of approximately 5 to 200 μm. In addition, the connection electrode 46 is electrically joined to an electrode included in the signal transmission unit.

As will be described in detail later, the driving signal is supplied from the control unit 88 to the individual electrode 44 through the signal transmission unit. The driving signal is supplied in a constant cycle in synchronization with the transport speed of the printing medium P.

The common electrode 42 is formed over substantially the entire surface in a surface direction in the region between the piezoelectric ceramic layer 40*a* and the piezoelectric ceramic layer 40*b*. In other words, the common electrode 42 extends so as to cover all of the pressurizing chambers 10 in the region that opposes the piezoelectric actuator substrate 40. The common electrode 42 is connected to a surface electrode (not illustrated) for the common electrode at a position that avoids an electrode group configured with the individual electrodes 44 on the piezoelectric ceramic layer 40*a*, via a through conductor formed by penetrating the piezoelectric ceramic layer 40*a*. In addition, the common electrode 42 is grounded via the surface electrode for the common electrode, and is held at the ground potential. Similar to the individual electrode 44, the surface electrode for the common electrode is directly or indirectly connected to the control unit 88.

A part of the piezoelectric ceramic layer 40*a* between the individual electrode 44 and the common electrode 42 is polarized in the thickness direction, and becomes the displacement element 50 having a unimorph structure. The displacement element 50 is driven (displaced) by the driving signal supplied to the individual electrode 44 via a driver IC or the like under the control of the control unit 88. The liquid can be discharged with various driving signals. For example, by using a so-called pulling-out driving method, the droplets can be discharged by supplying a driving signal of a pulse that keeps a low potential for a certain period of time with a high potential as a reference to the individual electrode 44.

In the present embodiment, the shape of the pressurizing chamber main body 10*a* is circular in plan view and has infinite rotational symmetry. The shape of the pressurizing chamber main body 10*a* may be a rotationally symmetric shape of a three-fold or more rotational symmetry in plan view. In addition, the opening of the first individual flow path 12 on a pressurizing chamber main body 10*a* side is disposed on a side opposite to the opening on the pressurizing chamber main body 10*a* side of the descender 10*b* with respect to the area center of gravity of the pressurizing chamber main body 10. More specifically, the opposite side means that the formed angle is 135 degrees or more.

In the second and third pressurizing chambers, the opening of the descender 10*b* on the pressurizing chamber main body 10*a* side is farther from the area center of gravity of the pressurizing chamber main body 10*a* than the first common flow path 20 and the second common flow path 22. The first individual flow path 12 is a part that reflects pressure waves, needs to have a high flow path resistance, and is formed into an elongated shape. In the first pressurizing chamber, the position where the descender 10*b* and the first individual flow path 12 are connected to each other is a position rotated by 90 degrees with respect to the second pressurizing chamber. The pressurizing chamber main bodies 10*a* are in a relationship of parallel translation without rotation. The first individual flow path 12 extends from the pressurizing chamber main body 10*a* in the direction of the first common flow path 20 and the second common flow path 22. The first individual flow path 12 connected to the first pressurizing chamber and the first individual flow path 12 connected to the third pressurizing chamber extend toward each other. The first individual flow path connected to the fourth pressurizing chamber and the first individual flow path 12 connected to the second pressurizing chamber extend toward each other.

REFERENCE SIGNS LIST

1 COLOR INK JET PRINTER
2 LIQUID DISCHARGE HEAD
2*a* HEAD MAIN BODY
4 (FIRST) FLOW PATH MEMBER
4*a* to 1 PLATE (OF FIRST FLOW PATH MEMBER)
4-1 PRESSURIZING CHAMBER SURFACE
4-2 DISCHARGE HOLE SURFACE
6 SECOND FLOW PATH MEMBER
6*a* to *f* PLATE (OF SECOND FLOW PATH MEMBER)
8 DISCHARGE HOLE
9A DISCHARGE HOLE ROW
10 PRESSURIZING CHAMBER
10*a* PRESSURIZING CHAMBER MAIN BODY
10*b* PARTIAL FLOW PATH
11A PRESSURIZING CHAMBER ROW
12 FIRST INDIVIDUAL FLOW PATH
14 SECOND INDIVIDUAL FLOW PATH
14*a* FIRST PART (OF SECOND INDIVIDUAL FLOW PATH)
14*b* SECOND PART (OF SECOND INDIVIDUAL FLOW PATH)
16 PRESSURIZING CHAMBER DISPOSITION REGION
18 STORAGE SPACE (OF PIEZOELECTRIC ACTUATOR SUBSTRATE)
18*a* THROUGH HOLE
20 FIRST COMMON FLOW PATH (COMMON SUPPLY FLOW PATH)
20*a* FIRST COMMON FLOW PATH MAIN BODY
20*b* OPENING (OF FIRST COMMON FLOW PATH)
22 SECOND COMMON FLOW PATH (COMMON DISCHARGE FLOW PATH)
22*a* SECOND COMMON FLOW PATH MAIN BODY
22*b* OPENING (OF SECOND COMMON FLOW PATH)
24 FIRST INTEGRATED FLOW PATH (SUPPLY FLOW PATH)
24*a*1 FIRST PART (OF FIRST INTEGRATED FLOW PATH)
24*a*2 STORAGE PORTION (OF FIRST INTEGRATED FLOW PATH)
24*a*3 BRANCH FLOW PATH (SUPPLY BRANCH FLOW PATH) (OF FIRST INTEGRATED FLOW PATH)
24*a*4 SECOND BRANCH FLOW PATH (OF FIRST INTEGRATED FLOW PATH)
24*b* OPENING (FIRST OPENING) (OF FIRST INTEGRATED FLOW PATH)
25 BYPASS FLOW PATH
26 SECOND INTEGRATED FLOW PATH (COLLECTING FLOW PATH)
26*a*1 FIRST PART (OF SECOND INTEGRATED FLOW PATH)
26*a*2 STORAGE PORTION (OF SECOND INTEGRATED FLOW PATH)
26*a*3 BRANCH FLOW PATH (COLLECTING BRANCH FLOW PATH) (OF SECOND INTEGRATED FLOW PATH)
26*a*4 SECOND BRANCH FLOW PATH (OF SECOND INTEGRATED FLOW PATH)
26*b* OPENING (SECOND OPENING) (OF SECOND INTEGRATED FLOW PATH)
40 PIEZOELECTRIC ACTUATOR SUBSTRATE
40*a* PIEZOELECTRIC CERAMIC LAYER
40*b* PIEZOELECTRIC CERAMIC LAYER (DIAPHRAGM)
42 COMMON ELECTRODE
44 INDIVIDUAL ELECTRODE
44*a* INDIVIDUAL ELECTRODE MAIN BODY
44*b* EXTRACTION ELECTRODE
46 CONNECTION ELECTRODE

50 DISPLACEMENT ELEMENT (PRESSURIZING UNIT)
70 HEAD-MOUNTED FRAME
72 HEAD GROUP
80A PAPER FEED ROLLER
80B COLLECTION ROLLER
82A to D TRANSPORT ROLLER
88 CONTROL UNIT
P PRINTING PAPER SHEET

The invention claimed is:

1. A liquid discharge head comprising:

a first flow path member extending longitudinally in a first direction, and from which a liquid is discharged; and a second flow path member extending longitudinally in the first direction, and comprising a supply flow path for sending the liquid to the first flow path member, and a collecting flow path for collecting the liquid not discharged from the first flow path member from the first flow path member, wherein the supply flow path comprises a first opening that is open to an outside, and a supply branch flow path connected to the first opening, the supply branch flow path branches out at a center portion of the second flow path member in the first direction, extends in the first direction and in a third direction which is opposite to the first direction, and is connected to the first flow path member at an end portion of the supply branch flow path in the first direction and an end portion of the supply branch flow path in the third direction, the collecting flow path comprises a second opening that is open to the outside, and a collecting branch flow path connected to the second opening, the collecting branch flow path branches out at the center portion of the second flow path member in the first direction, extends in the first direction and in the third direction, and is connected to the first flow path member at an end portion of the collecting branch flow path in the first direction and an end portion of the collecting branch flow path in the third direction, and in a plan view, at least a part of the supply branch flow path and at least a part of the collecting branch flow path overlap.

2. The liquid discharge head according to claim 1, wherein the collecting branch flow path is disposed on a side of the supply branch flow path opposite to an opposite side of the supply branch flow path where the first flow path member is disposed.

3. The liquid discharge head according to claim 1, wherein in the plan view, a first connection portion between the end portion of the collecting branch flow path in the first direction and the first flow path member is disposed closer to a first direction side than a second connection portion between the end portion of the supply branch flow path in the first direction and the first flow path member, and a third connection portion between the end portion of the collecting branch flow path in the third direction and the first flow path member is disposed closer to a third direction side than a fourth connection portion between the end portion of the supply branch flow path in the third direction and the first flow path member.

4. The liquid discharge head according to claim 1, wherein the supply flow path comprises a supply storage portion between the first opening and the supply branch flow path, the supply storage portion having a supply sectional area larger than other supply sectional areas of portions of the supply flow path adjacent to the supply storage portion, the collecting flow path comprises a collecting storage portion between the second opening and the collecting branch flow path, the collecting flow path having a storage sectional area larger than other storage sectional areas of portions of the collecting flow path adjacent to the collecting storage portion, and in the plan view, the supply storage portion and the collecting storage portion are disposed and displaced in a second direction which intersects with the first direction from the supply branch flow path and the collecting branch flow path, and the supply storage portion and the collecting storage portion are disposed side by side in the first direction.

5. The liquid discharge head according to claim 4, wherein a fifth connection portion, which is between a portion of the supply flow path extending from the supply storage portion toward the supply branch flow path and the supply storage portion, is disposed at a position closer to a center of the second flow path member in the first direction than a sixth connection portion, which is between a portion of the collecting flow path extending from the collecting storage portion toward the collecting branch flow path and the collecting storage portion.

6. The liquid discharge head according to claim 4, wherein the supply storage portion and the collecting storage portion are connected by a bypass flow path.

7. The liquid discharge head according to claim 6, wherein a flow path resistance of the bypass flow path is larger than a flow path resistance of the supply branch flow path.

8. A recording apparatus, comprising:

the liquid discharge head according to claim 1;

a transport unit that transports a recording medium toward the liquid discharge head; and a control unit that controls the liquid discharge head.

* * * * *